US007087121B2

(12) United States Patent
Herschberger

(10) Patent No.: US 7,087,121 B2
(45) Date of Patent: Aug. 8, 2006

(54) DEVICE AND METHOD FOR CLEANING A SURFACE OF A MEMBER FOR STORING AND TRANSPORTING GOODS

(76) Inventor: John L. Herschberger, 15356 Shedd Rd., Middlefield, OH (US) 44062

( * ) Notice: Subject to any disclaimer, the term of this patent is extended or adjusted under 35 U.S.C. 154(b) by 403 days.

(21) Appl. No.: 10/263,125

(22) Filed: Oct. 2, 2002

(65) Prior Publication Data

US 2003/0066154 A1 Apr. 10, 2003

Related U.S. Application Data

(60) Provisional application No. 60/327,927, filed on Oct. 9, 2001.

(51) Int. Cl.

| | |
|---|---|
| ***B08B 5/00*** | (2006.01) |
| ***B08B 5/02*** | (2006.01) |
| ***B08B 5/04*** | (2006.01) |
| ***A47L 5/38*** | (2006.01) |

(52) U.S. Cl. ..... 134/21; 15/308; 15/309.2; 15/77; 134/6; 134/18

(58) Field of Classification Search ..... 15/53.2, 15/53.3, 77, 306.1, 308, 309, 309.1, 309.2, 15/345, DIG. 2, 88.3; 134/6, 18, 21, 31, 134/42

See application file for complete search history.

(56) References Cited

U.S. PATENT DOCUMENTS

| | | | | | |
|---|---|---|---|---|---|
| 872,823 | A | * | 12/1907 | Ketzler | 15/40 |
| 1,507,596 | A | * | 9/1924 | Graves | 15/88.3 |
| 1,536,186 | A | * | 5/1925 | Arnold | 15/77 |
| 1,678,064 | A | * | 7/1928 | Jones et al. | 15/88.3 |
| 2,015,583 | A | * | 9/1935 | Bartsch | 15/308 |
| 2,181,266 | A | * | 11/1939 | Durup | 15/77 |
| 3,217,348 | A | | 11/1965 | Simmons | |
| 3,594,843 | A | * | 7/1971 | Sesia et al. | 15/53.2 |
| 3,849,820 | A | | 11/1974 | Lang | |
| 4,196,486 | A | * | 4/1980 | Capra | 15/53.2 |
| 4,250,591 | A | * | 2/1981 | Mello | 15/309.2 |
| 4,301,566 | A | * | 11/1981 | Weigele | 15/53.2 |
| 4,428,090 | A | | 1/1984 | Coggin et al. | |
| 4,777,687 | A | * | 10/1988 | Cann et al. | 15/1.51 |
| 4,946,513 | A | * | 8/1990 | Del Prato et al. | 134/18 |
| 5,008,968 | A | * | 4/1991 | Preston | 15/1.51 |
| 5,372,153 | A | | 12/1994 | Dobson | |
| 5,405,450 | A | * | 4/1995 | Mifsud | 134/1 |
| 5,446,942 | A | | 9/1995 | Whitehorn | |
| 5,642,766 | A | | 7/1997 | MacCauley, III | |
| 5,779,024 | A | | 7/1998 | Harper | |
| 5,980,646 | A | * | 11/1999 | DeRosa | 134/21 |
| 6,129,099 | A | | 10/2000 | Foster et al. | |

(Continued)

*Primary Examiner*—Terrence R. Till
(74) *Attorney, Agent, or Firm*—Tarolli, Sundheim, Covell & Tummino LLP

(57) ABSTRACT

A method and device for removing sawdust from a deck surface (24) of a wooden pallet (10) is provided. The device comprises a rotary brush (124) having a working length (WL) defined by a plurality of bristles (130). The working length (WL) is greater than a width (WD) of the deck surface (24). A mechanism (136) is connected with the rotary brush (124) and is actuatable for rotating the rotary brush (124). A support (32) rotatably supports the rotary brush (124). The mechanism (136) is fixed relative to the support (32). Rotation of the rotary brush (124) when the bristles (130) are in contact with the deck surface (24) of the wooden pallet (10) simultaneously removes sawdust and debris across the width (WD) of the deck surface (24).

32 Claims, 2 Drawing Sheets

U.S. PATENT DOCUMENTS

2002/0078515 A1* 6/2002 Biddix et al. ..... 15/77
2003/0046787 A1* 3/2003 Howard ..... 15/308
2003/0150475 A1* 8/2003 Abrams et al. ..... 134/1

* cited by examiner

DEVICE AND METHOD FOR CLEANING A SURFACE OF A MEMBER FOR STORING AND TRANSPORTING GOODS

RELATED APPLICATIONS

This application claims the benefit of U.S. Provisional Application No. 60/327,927, which was filed on Oct. 9, 2001.

TECHNICAL FIELD

The present invention relates to a device for cleaning a surface of a member for storing and transporting goods. More particularly, the present invention relates to a device for removing dust and other debris from at least one surface of a member for storing and transporting goods.

BACKGROUND OF THE INVENTION

Wooden pallets are used for storing and transporting goods. Each wooden pallet includes an upper deck surface upon which goods are placed and a lower deck surface fox supporting the wooden pallet.

Generally, wooden pallets are manufactured using an automated process. A number of runners are placed parallel to one another on a pallet manufacturing device. The pallet manufacturing device then places a first plurality of deck boards in a position perpendicular to the runners and extending across the runners. An automatic nailer fastens the deck boards to the runners. The partially manufactured pallet is then flipped over so that the attached first plurality of deck boards are located beneath the runners. Next, the pallet manufacturing device places a second plurality of deck boards in a positioned perpendicular to the runner and extending across the runners. The second plurality of deck boards extends parallel to the first plurality of deck boards and is located on an opposite side of the runners from the first plurality of deck boards. The automatic nailer fastens the second plurality of deck boards to the runners. The first plurality of deck boards forms the lower deck surface of the wooden pallet and the second plurality of deck boards forms the upper deck surface of the wooden pallet.

During and after the manufacture of a wooden pallet, sawdust and other debris may be present on the deck surfaces of the wooden pallet. When certain goods are placed on a wooden pallet, it is desirable, and sometimes necessary, for the sawdust and other debris to be removed from the deck surfaces of the wooden pallet.

Slip sheets may be placed between layers of goods supported on the upper deck surface of a wooden pallet. Generally, a slip sheet is a thin cardboard member that provides support between adjacent layers of goods. During manufacturing and cutting of slip sheets, dust and other debris may collect on the surfaces of the slip sheet. It is also desirable, and sometimes necessary, to remove the dust and other debris from the surfaces of the slip sheets.

SUMMARY OF THE INVENTION

The present invention is a device for removing sawdust and other debris from a deck surface of a wooden pallet. The device comprises a rotary brush having a core and a plurality of bristles. The plurality of bristles extends radially outwardly of the core. An axial length of the bristles on the core defines a working length of the rotary brush. The working length is greater than a width of the deck surface of the wooden pallet. A mechanism is connected with the core of the rotary brush and is actuatable for rotating the rotary brush. The device also comprises a support for rotatably supporting the rotary brush. The mechanism is fixed relative to the support. Rotation of the rotary brush when the bristles are in contact with the deck surface of the wooden pallet simultaneously removes sawdust and debris across the width of the deck surface.

In another aspect of the invention, a method of removing sawdust and other debris from a deck surface of a wooden pallet is provided. The method comprises the step of providing a rotary brush having a core and a plurality of bristles. The plurality of bristles extends radially outwardly of the core. An axial length of the bristles on the core defines a working length of the rotary brush. The working length is greater than a width of the deck surface of the wooden pallet. The method also comprises the steps of providing a mechanism for rotating the rotary brush and rotatably supporting the rotary brush. The method further comprises the step of actuating the mechanism to rotate the rotary brush so that the bristles contact the deck surface of the wooden pallet for simultaneously removing sawdust and debris across the width of the deck surface.

According to yet another aspect, the present invention is device for removing dust and other debris from a member upon which goods are stored and transported. The device comprises a first rotary brush having a working length defined by a plurality of bristles. The working length of the first rotary brush is greater than a width of an upper stacking surface of the member. The device also includes a support for rotatably supporting the first rotary brush and locking the first rotary brush in a position for enabling the working length of the first rotary brush to overlie and contact the width of the upper stacking surface of the member. A first drive mechanism is connected with the first rotary brush and is energizable for rotating the first rotary brush to remove dust and debris across the width of the upper stacking surface during movement of the member relative to the device.

In another aspect of the invention, a method of removing dust and other debris from a member upon which goods are stored and transported is provided. The method comprises the step of providing a first rotary brush having a working length defined by a plurality of bristles. The working length is greater than a width of an upper stacking surface of the member. The method also includes the steps of rotatably supporting the first rotary brush and locking the first rotary brush in a position for enabling the working length of the first rotary brush to overlie and contact the width of the upper stacking surface of the member. The method still further includes the step of energizing a first drive mechanism, that is connected with the first rotary brush, for rotating the first rotary brush to remove dust and debris across the width of the upper stacking surface during movement of the member relative to the device.

BRIEF DESCRIPTION OF THE DRAWINGS

The foregoing and other features of the present invention will become apparent to those skilled in the art to which the present invention relates upon reading the following description with reference to the accompanying drawings in which.

DETAILED DESCRIPTION OF THE INVENTION

Figure 1:
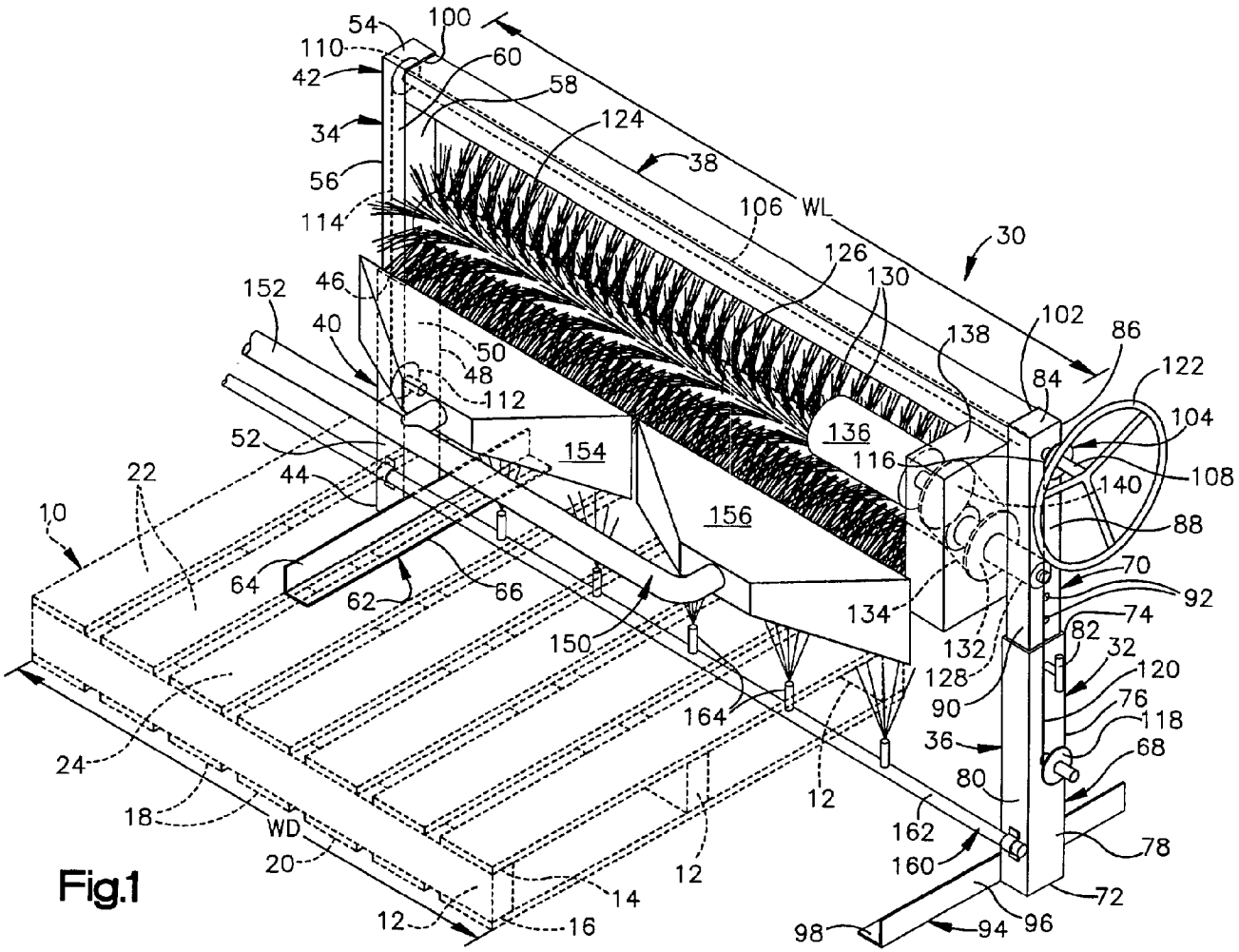
FIG. 1 is a perspective view of a device constructed in accordance with the present invention.

A wooden pallet 10, shown by dotted lines in FIG. 1, generally includes a plurality of runners 12, three of which are shown. The runners 12 include upper and lower sides 14 and 16, respectively. A first plurality of deck boards 18 is fastened to a lower side 16 of the runners 12. The first plurality of deck boards 18 forms a lower deck surface 20 of the wooden pallet 10. A second plurality of deck boards 22 is fastened to an upper side 14 of the runners 12. The second plurality of deck boards 22 forms an upper deck surface 24 of the wooden pallet 10.

A wooden pallet 10 is generally manufactured using an automated process. After the second plurality of deck boards 22 is fastened to the runners 12, the assembled wooden pallet 10 is moved from a pallet manufacturing device (not shown) to a stacking device (not shown) where the wooden pallet is stacked upon a previously assembly wooden pallet. Generally, an assembled wooden pallet 10 is moved from the pallet manufacturing device to the stacking device on a conveyor (not shown). The conveyor includes an endless chain (not shown) for supporting the wooden pallet 10 and moving the wooden pallet from the pallet manufacturing device to the stacking device. The endless chain may include a plurality of rollers for contacting the lower deck surface 20 of the wooden pallet 10. The rollers reduce friction between the lower deck surface 20 of the wooden pallet 10 and the endless chain of the conveyor for facilitating the placing and removing of the wooden pallet from the conveyor. The endless chain also includes a plurality of apertures for allowing air flow through the endless chain.

The device 30 of the present invention is adaptable to clean wooden pallets 10 as the conveyor is moving the wooden pallets. The device 30 includes a support 32. The support 32 comprises first and second legs 34 and 36, respectively, and a crossbeam 38 that connects the first and second legs.

The first leg 34 of the support 32 includes a lower portion 40 and an upper portion 42. The lower portion 40 of the first leg 34 is a hollow conduit having first and second ends 44 and 46, respectively, and a rectangular cross-sectional shape. The rectangular cross-sectional shape defines an inner surface (not shown) and an outer surface 48. The outer surface 48 of the lower portion 40 includes an inside surface 50 and an opposite outside surface (not shown), and a forward surface 52 and an opposite rearward surface (not shown).

A threaded aperture (not shown) extends from the outside surface of the lower portion 40 of the first leg 34 to the conduit that is defined by the inner surface of the lower portion of the first leg. A thumbscrew (not shown) is receivable in the threaded aperture.

The upper portion 42 of the first leg 34 also has a first end (not shown) and a second end 54 and a rectangular cross-sectional shape. An outer surface 56 of the upper portion 42 includes an inside surface 58 and an opposite outside surface (not shown), and a forward surface 60 and an opposite rearward surface (not shown). The first end of the upper portion 42 of the first leg 34 is received telescopically in the second end 46 of the lower portion 40 of the first leg so that the inside surface of the upper portion of the first leg is adjacent the inside surface of the lower portion of the first leg. The outside surface of the upper portion 42 of the first leg 34 includes a plurality of apertures (not shown) that are spaced axially from one another. The plurality of apertures is located between the first end of the upper portion 42 and a center position between the first and second ends (second end shown at 54) of the upper portion of the first leg 34. Each of the plurality of apertures is aligned to mate with the threaded aperture of the lower portion 40 of the first leg 34 as the upper portion 42 of the first leg is received telescopically in the lower portion.

A larger diameter aperture (not shown) extends through the upper portion 42 of the first leg 34 in a location between the center position and the second end 54 of the upper portion. The larger diameter aperture extends from the outside surface of the upper portion 42 of the first leg 34 and through the inside surface 58.

A first leveling beam 62 is attached to the inside surface 50 of the first end 44 of the lower portion 40 of the first leg 34. The first leveling beam 62 has an L-shaped cross-section with a vertically extending portion 64 and a horizontally extending portion 66. The vertically extending portion 64 of the first leveling beam 62 is attached to the inside surface 50 of the lower portion 40 of the first leg 34. In one embodiment, the vertically extending portion 64 of the first leveling beam 62 is welded to the inside surface 50 of the lower portion 40 of the first leg 34 adjacent the first end 44 of the lower portion.

The horizontally extending portion 66 of the first leveling beam includes three apertures (not shown). A central aperture (not shown) is located near the lower portion 40 of the first leg 34 and may be used to anchor the first leg to a surface such as the floor. Two outer apertures (not shown) are threaded and may receive threaded studs or bolts for leveling the first leg 34.

The second leg 36 includes a lower portion 68 and an upper portion 70. The lower portion 68 of the second leg 36 is a hollow conduit having first and second ends 72 and 74, respectively, and a rectangular cross-sectional shape. The rectangular cross-sectional shape defines an inner surface (not shown) and an outer surface 76. The outer surface 76 of the lower portion 68 includes an inside surface (not shown) and an opposite outside surface 78, and a forward surface 80 and an opposite rearward surface (not shown).

A threaded aperture (not shown) extends from the outside surface 78 of the lower portion 68 of the second leg 36 to the conduit that is defined by the inner surface of the lower portion of the second leg. A thumbscrew 82 is receivable in the threaded aperture.

The upper portion 70 of the second leg 36 also has a first end (not shown) and a second end 84 and a rectangular cross-sectional shape. An outer surface 86 of the upper portion 70 includes an inside surface (not shown) and an opposite outside surface 88, and a forward surface 90 and an opposite rearward surface (not shown). The first end of the upper portion 70 of the second leg 36 is received telescopically in the second end 74 of the lower portion 68 of the second leg 36 so that the inside surface of the upper portion of the second leg is adjacent the inside surface of the lower portion of the second leg. The outside surface 88 of the upper portion 70 of the second leg 36 includes a plurality of apertures 92 that are spaced axially from one another. The plurality of apertures 92 is located between the first end of the upper portion 70 and a center position between the first and second ends (second end shown at 84) of the upper portion of the second leg 36. Each of the plurality of apertures 92 is aligned to mate with the threaded aperture of the lower portion 68 of the second leg 36 as the upper portion 70 of the second leg is received telescopically in the lower portion.

A larger diameter aperture (not shown) extends through the upper portion 70 of the second leg 36 in a location between the center position and the second end 84. The larger diameter aperture extends from the outside surface 88 of the upper portion 70 of the second leg 36 to the inside surface.

A second leveling beam 94 is attached to the inside surface of the first end 72 of the lower portion 68 of the second leg 36. The leveling beam 94 has an L-shaped cross-section with a vertically extending portion 96 and a horizontally extending portion 98. The vertically extending portion 96 of the second leveling beam 94 is attached to the inside surface of the lower portion 68 of the second leg 36. In one embodiment, the vertically extending portion 96 of the second leveling beam 94 is welded to the inside surface of the lower portion 68 of the second leg 36 adjacent the first end 72 of the lower portion.

The horizontally extending portion 98 of the second leveling beam includes three apertures (not shown). A central aperture (not shown) is located near the lower portion 68 of the second leg 36 and may be used to anchor the second leg to a surface such as the floor. Two outer apertures (not shown) are threaded and may receive threaded studs or bolts for leveling the second leg 36.

The crossbeam 38 also is formed from a hollow conduit having a rectangular cross-sectional shape. The crossbeam has first and second ends 100 and 102, respectively. A first end 100 of the crossbeam 38 is attached to the inside surface 58 of the upper portion 42 of the first leg 34, adjacent the second end 54 of the upper portion of the first leg. The crossbeam 38 extends perpendicular to the first leg 34. A second end 102 of the crossbeam 38 is attached to the inside surface of the upper portion 70 of the second leg 36, adjacent the second end 84 of the upper portion of the second leg. The crossbeam 38 extends perpendicular to the second leg 36 and the second leg extends relative to the crossbeam in the same direction as the first leg 34. Thus, the crossbeam 38 connects the first and second legs 34 and 36.

The device 30 also includes structure 104 for adjusting the height of the crossbeam 38. The structure 104 includes a drive shaft 106 that extends through the crossbeam 38 of the support 32. The drive shaft 106 has a first end (not shown) and a second end 108. The first end extends outwardly of the outside surface of the upper portion 42 of the first leg 34 and supports a first sprocket wheel 110, shown by dashed lines. A second sprocket wheel 112, also shown by dashed lines, is fixed to the outside surface of the lower portion 40 of the first leg 34. A first chain 114 extends between the first and second sprocket wheels 110 and 112. A first end of the first chain 114 is fixed to the first sprocket wheel 110 and a second end of the first chain is fixed to the second sprocket wheel 112.

The second end 108 of the drive shaft 106 extends outwardly of the outside surface 88 of the upper portion 70 of the second leg 36 and supports a third sprocket wheel 116. The third sprocket wheel 116 has the same dimensions as the first sprocket wheel 110. A fourth sprocket wheel 118 is fixed to the outside surface 78 of the lower portion 68 of the second leg 36. The fourth sprocket wheel 118 has the same dimensions as the second sprocket wheel 114. A second chain 120 extends between the third and fourth sprocket wheels 116 and 118. A first end of the second chain 120 is fixed to the third sprocket wheel 116 and a second end of the second chain 120 is fixed to the fourth sprocket wheel 118.

An input wheel 122 is attached to the second end of the drive shaft 108 outside of the third sprocket wheel 116. A first biasing element or spring (not shown) supports the upper portion 42 of the first leg 34 in an uppermost position within the lower portion 40 of the first leg. A second biasing element or spring (not shown) supports the upper portion 70 of the second leg 36 in an uppermost position within the lower portion 68 of the second leg.

To adjust the height of the crossbeam 38 of the support 32 relative to the first and second leveling beams 62 and 94, the input wheel 122 is manually turned. When the crossbeam 38 is in an uppermost position, turning of the input wheel 122 rotates the first sprocket wheel 110 relative to the second sprocket wheel 112 and simultaneously rotates the third sprocket wheel 116 relative to the fourth sprocket wheel 118. As a result, a portion of the first chain 114 is engaged by the first sprocket wheel 110 and begins to wrap around the circumference of the first sprocket wheel and a portion of the second chain 120 is engaged by the third sprocket wheel 116 and begins to wrap around the circumference of the third sprocket wheel. This action reduced the length of the first chain 114 between the first and second sprocket wheels 110 and 112 and the length of the second chain 120 between the third and fourth sprocket wheels 116 and 118 and lowers the crossbeam 38 against the bias of the biasing elements. When a desired height is achieved, the thumbscrews (only 82 shown) can be tightened to lock the crossbeam 38 of the support 32 at the desired height.

In one embodiment, the first and third sprocket wheels 110 and 116 include a ratchet mechanism (not shown) to hold the position of the crossbeam 38 while the thumbscrews 82 are moved into a locking position. To raise the crossbeam 38, the thumbscrews 82 are removed or loosened, the ratchets are unlocked and the input wheel 122 is turned in a direction to simultaneously release a portion of the first chain 114 from the first sprocket wheel 110 and a portion of the second chain 120 from the third sprocket wheel 116.

The pallet cleaning device further includes a rotary brush 124. The rotary brush 124 includes a core 126 that forms an axis of rotation for the rotary brush. In one embodiment, the core 126 is a six inch diameter tube having first and second ends. The core 126 may include a hub (not shown). A support shaft 128 projects axially through the core 126. The hub of the core 126 fixes the support shaft 128 relative to the core. In one embodiment, the support shaft has a one inch diameter.

A plurality of bristles 130 projects radially outwardly from the core 126 of the rotary brush 124. In one embodiment the bristles 130 form a plurality of helically extending paths around the core 126. The bristles 130 may all have a common length or may be of differing lengths. Additionally, bristles 130 may all have a common thickness or may be of differing thickness. For example, thin bristles (not shown) that are approximately three and a half inches long may be provided for removing sawdust and other loose particles of debris. These thin bristles flex or bend easily when contacting the upper deck surface 24 of the wooded pallet 10. Thick bristles (not shown) that are approximately 3 inches long may be provided for removing heavy debris. These thicker bristles are stiffer and more likely to scrape or pull debris off of the upper deck surface 24 of the wooden pallet 10.

The plurality of bristles 130 defines a working length WL of the rotary brush 124. The working length WL is measured in a direction parallel to the core 126 and is the portion of the rotary brush 124 that actually removes sawdust and debris from the upper deck surface 24 of the wooden pallet 10. The working length WL of the rotary brush 124 is greater than the width WD of the upper deck surface 24 of the wooden pallet 10. In one embodiment, the working length WL of the rotary brush 124 is sixty inches in length.

Two bearings (not shown) are used to mount the rotary brush 124 to the support 32. The first end of the support shaft 128 of the rotary brush 124 is received in the large diameter aperture in the upper portion 42 of the first leg 34 and extends through the larger diameter aperture and outwardly of the outside surface of the first leg 34. A first bearing (not shown) is attached to the outside surface of the upper portion 42 of the first leg 34 and receives the first end of the support shaft 128 for rotatably supporting the rotary brush 124. The second end of the support shaft 128 of the rotary brush 124 is received in the large diameter aperture in the upper portion 70 of the second leg 36 and extends through the larger diameter aperture and outwardly of the outside surface 88 of the second leg 36. A second bearing (not shown) is attached to the outside surface 88 of the upper portion 70 of the second leg 36 and receives the second end of the support shaft 128 for rotatably supporting the rotary brush 124. Since the first and second bearings are located on the outside surfaces of the upper portions 42 and 70 of the first and second legs 34 and 36, respectively, the first and second bearings are removed from the path of sawdust and debris removed from the upper deck surface 24 of the wooden pallet 10 by the rotary brush 124.

A first pulley 132 is fixed to the support shaft 128 of the rotary brush 124 for receiving a drive belt 134. When the rotary brush 124 is rotatably attached to the support 32, the first pulley 132 is located adjacent the inside surface of the upper portion 70 of the second leg 36.

An electric motor 136 is attached to a support plate 138 and is fixed relative to the support 32. As shown in FIG. 1, the support plate 138 is attached to the crossbeam 38 of the support 32. In one embodiment, the electric motor 136 is a one-eighth horsepower motor. A second pulley 140 is fixed to an output shaft of the electric motor 136 and is rotated upon rotation of the output shaft of the electric motor. The drive belt 134 extends around the first and second pulleys 132 and 140. Rotation of the second pulley 140 is transferred to the first pulley 132 via the drive belt 134 and results in the rotation of the rotary brush 124.

The device 30 also includes a vacuum system 150. The vacuum system 150 is connectable to a main vacuum line 152. The vacuum system includes first and second hoods 154 and 156 for suctioning dust and debris. Both the first and second hoods 154 and 156 are connectable to the main vacuum line 152.

Although described below, the specific structure of the first and second hoods 154 and 156 is not numbered in the drawing. The first hood 154 includes a generally rectangular end wall and four generally trapezoidal side walls. Narrow ends of the four side walls connect to the end wall. Wide ends of the four side walls form a rectangular opening into the first hood. The end wall is connectable to the main vacuum line 152. When the vacuum system is actuated, suction pulls sawdust and debris through the opening into the first hood and out of the first hood into the main vacuum line 152.

The second hood 156 also includes a generally rectangular end wall and four generally trapezoidal side walls. Narrow ends of the four side walls connect to the end wall. Wide ends of the four side walls form a rectangular opening into the second hood. The end wall is connectable to the main vacuum line 152. When the vacuum system is actuated, suction pulls sawdust and debris through the opening into the second hood and out of the second hood into the main vacuum line 152.

The first and second hoods 154 and 156 are supported adjacent the rotary brush 124. Preferably, the first and second hoods 154 and 156 are located on a forward side of the rotary brush 124 and, when positioned adjacent one another, collectively extend across the working length WL of the rotary brush for collecting sawdust and debris removed from the wooden pallet 10.

The device 30 also includes an air system 160. The air system 160 includes a tubular plenum 162 and a plurality of nozzles 164. As shown in FIG. 1, the plenum 162 is attached to the lower portions 42 and 68 of the first and second legs 34 and 36, respectively, of the support 32 and extends from the first leg to the second leg. The plenum 162 is connectable to a compressed air line.

The plurality of nozzles 164 extends outwardly of the plenum 162. Each nozzle 164 is directed upward toward the rotary brush 124. The nozzles 164 are located below the rotary brush 164 by a sufficient distance that a wooden pallet 10 being carried on the endless chain can pass between the nozzles and the rotary brush. In one embodiment, the plenum 162 and the nozzles 164 are located between an upper and lower run of the endless chain of the conveyor.

The device 30 may also include an electronic eye (not shown). The electronic eye is a known device that senses the presence of a wooden pallet 10 approaching the device 30. The electronic eye is preferably mounted adjacent the conveyor on a forward side of the device 30. The electronic eye is connected to the air system 160. When the electronic eye senses the approach of a wooden pallet 10, the electronic eye actuates the air system 160 to direct compressed air through the nozzles 164. The electronic eye may also be used to actuate the vacuum system 150 and the electric motor 136.

As an alternate configuration of the present invention, the air system 160 could be replaced with another rotary brush (not shown) having a plurality of bristles for removing dust and debris from the lower deck surface 20 of the wooden pallet 10.

To facilitate removal of sawdust and debris, the rotary brush 124 is positioned by the height adjustment structure 104 so that approximately one inch or less of each bristle 130 contacts the upper deck surface 24 of the wooden pallet 10. The rotary brush 124 preferably rotates in a direction so that contact between the bristles 130 and the upper deck surface 24 is in a direction opposite to the direction of movement of the wooden pallet 10 on the conveyor. As the rotary brush 124 sweeps across the upper deck surface 24, sawdust and other debris is flung in a forward direction toward the first and second hoods 154 and 156 of the vacuum system 150. The vacuum system 150 removes the dust and debris from the area.

When actuated by the electronic eye, compressed air enters the plenum 162 and is ejected from the nozzles 164. The air is directed through the chain conveyor and against the lower deck surface 20 of the wooden pallet 10. The air flow removes sawdust and debris from the lower deck surface 20 and creates an air flow upward toward the vacuum system 150. Any sawdust or debris carried in the air flow is removed by the vacuum system 150. The air flow from the nozzles 164 also prevents sawdust and other debris from falling between the deck boards 22 of the upper deck surface 24 and out of the range of the vacuum system 150.

Since the working length WL of the rotary brush 124 is greater than a width WD of the upper deck surface 24 of the wooden pallet 10, the rotary brush 124 can simultaneously remove sawdust and other debris across the width to the upper deck surface of the wooden pallet. Additionally, the use of compressed air to remove sawdust and debris from the lower deck surface 20 ensures that sawdust and debris is not transferred from the lower deck surface of one wooden pallet 10 to the upper deck surface 24 of another wooden pallet when the stacking device stacks the wooden pallets.

Figure 2:
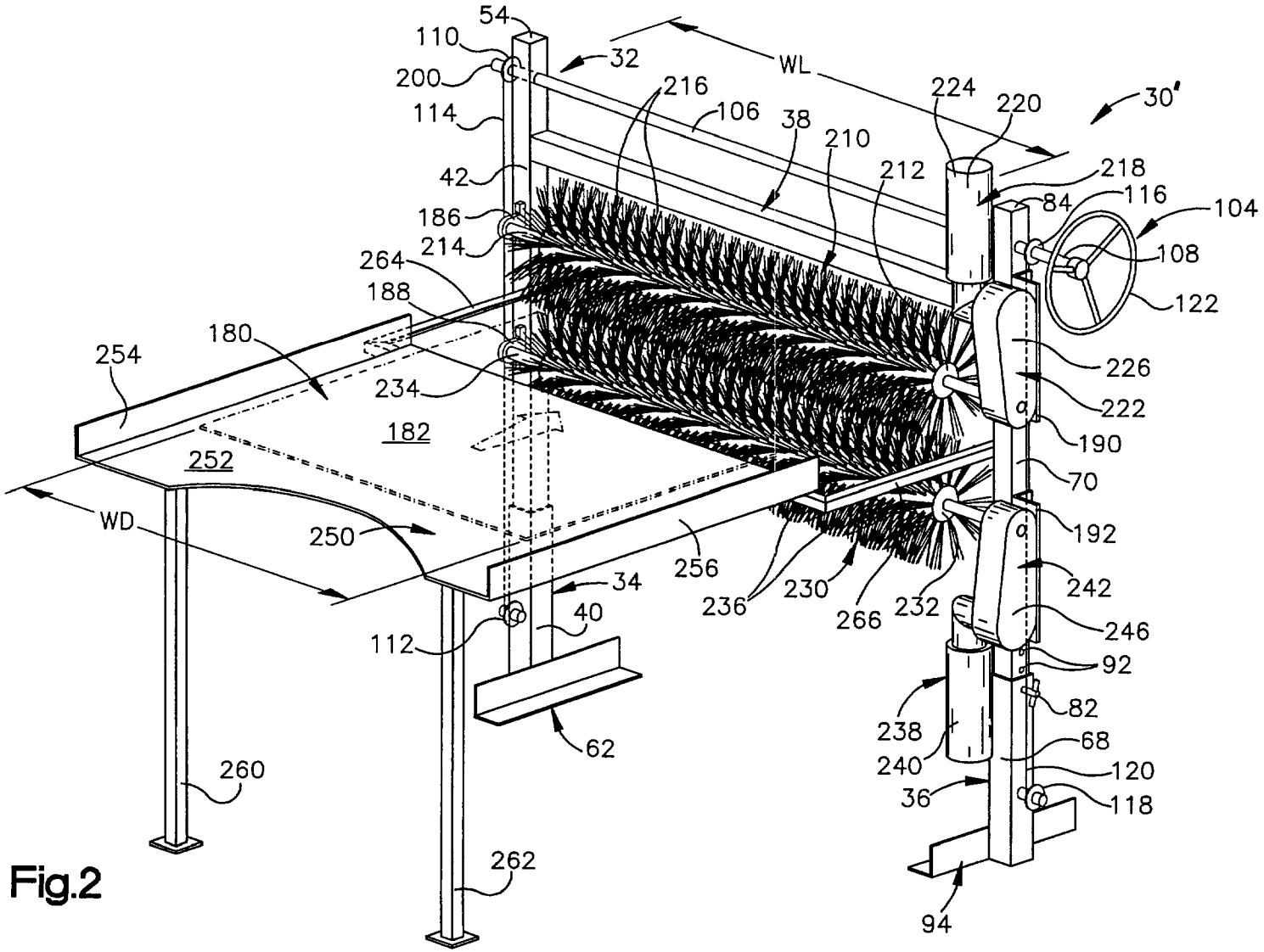
FIG. 2 is a perspective view of a device constructed in accordance with a second embodiment of the present invention.

FIG. 2 is a perspective view of a device 30' constructed in accordance with a second embodiment of the present invention. Structures of FIG. 2 that are the same or similar to those described in FIG. 1 are identified by the same reference number as in FIG. 1.

FIG. 2 illustrates a device 30' for cleaning both the upper and lower surfaces (upper surface shown at 182) of a slip sheet 180. The upper and lower surfaces 182 of the slip sheet 180 have a width WD, as shown in FIG. 2. The device 30' of FIG. 2 may also be used for cleaning both the upper and lower deck surfaces 24 and 20 of a wooden pallet 10.

The device 30' includes a support 32. The support 32 comprises first and second legs 34 and 36, respectively, and a crossbeam 38 that connects the first and second legs.

The first leg 34 of the support 32 includes a lower portion 40 and an upper portion 42. The lower portion 40 of the first leg 34 is a hollow conduit for receiving telescopically the upper portion 42 of the first leg 34. A first leveling beam 62 is attached to lower portion 40 of the first leg 34.

A threaded aperture (not shown) extends from the outside surface of the lower portion 40 of the first leg 34 to the conduit that is defined by the inner surface of the lower portion of the first leg. A thumbscrew (not shown) is receivable in the threaded aperture.

The outside surface of the upper portion 42 of the first leg 34 includes a plurality of apertures (not shown) that are spaced axially from one another. Each of the plurality of apertures is aligned to mate with the threaded aperture of the lower portion 40 of the first leg 34 as the upper portion of the first leg is received telescopically in the lower portion. A portion of the thumbscrew, when threaded into the threaded aperture, is received in one of the apertures to lock the upper portion 42 of the first leg 34 relative to the lower portion 40.

Upper and lower brackets 186 and 188 are fixed to the upper portion 42 of the first leg 34. Each of the brackets 186 and 188 includes a base portion that is affixed to the upper portion 42 of the first leg 34 and a support portion for supporting a rotary bearing. The upper and lower brackets 186 and 188 are spaced from one another along the upper portion 42 of the first leg 34.

The second leg 36 includes a lower portion 68 and an upper portion 70 that is received telescopically in the lower portion. A second leveling beam 94 is attached to the lower portion 68 of the second leg 36.

A threaded aperture (not shown) extends from the outside surface of the lower portion 68 of the second leg 36 to the conduit that is defined by the inner surface of the lower portion of the second leg. A thumbscrew 82 is receivable in the threaded aperture.

The upper portion 70 of the second leg 36 includes a plurality of apertures 92 that are spaced axially from one another. Each of the plurality of apertures 92 is aligned to mate with the threaded aperture of the lower portion 68 of the second leg 36 as the upper portion of the second leg is received telescopically in the lower portion. A portion of the thumbscrew 82, when threaded into the threaded aperture, is received in one of the apertures 92 to lock the upper portion 70 of the second leg 36 relative to the lower portion 68.

Upper and lower brackets (not shown) are also fixed to the upper portion 70 of the second leg 36. The upper and lower brackets of the second leg 36 are identical to the upper and lower brackets 186 and 188 of the first leg 34. The upper and lower brackets are spaced from one another along the upper portion 70 of the second leg 36.

The upper portion 70 of the second leg 36 also includes upper and lower support brackets 190 and 192, respectively. Each of the upper and lower support brackets 190 and 192 has an L-shaped cross-section. The upper support bracket 190 extends upwardly from a position adjacent the location of the upper bracket. The lower support bracket 192 extends downwardly from a position adjacent the location of the lower bracket.

The crossbeam 38 extends horizontally between the upper portion 42 of the first leg 34 and the upper portion 70 of the second leg 36 and secures the first leg to the second leg. The crossbeam 38 is spaced approximately six to eight inches from the upper ends 54 and 84 of the upper portions 42 and 70 of the first and second legs 34 and 36, respectively.

The device 30' also includes structure 104 for adjusting the height of the crossbeam 38 relative to the first and second leveling beams 62 and 94. The structure 104 includes a drive shaft 106 that is rotatably supported relative to the first and second legs 34 and 36. A bearing that is received in an aperture of the upper portion 42 of the first leg 34, between the crossbeam 38 and the upper end 54, supports the drive shaft 106 for rotation relative to the first leg. A bearing that is received in an aperture of the upper portion 70 of the second leg 36, between the crossbeam 38 and the upper end 84, supports the drive shaft 106 for rotation relative to the second leg.

The drive shaft 106 has a first end 200 and a second end 108. The first end 200 extends outwardly of the upper portion 42 of the first leg 34 and supports a first sprocket wheel 110. A second sprocket wheel 112 is fixed to the outside surface of the lower portion 40 of the first leg 34. A first chain 114 extends between the first and second sprocket wheels 110 and 112. A first end of the first chain 114 is fixed to the first sprocket wheel 110 and a second end of the first chain is fixed to the second sprocket wheel 112.

The second end 108 of the drive shaft 106 extends outwardly of the upper portion 70 of the second leg 36 and supports a third sprocket wheel 116. The third sprocket wheel 116 has the same dimensions as the first sprocket wheel 110. A fourth sprocket wheel 118 is fixed to the lower portion 68 of the second leg 36. The fourth sprocket wheel 118 has the same dimensions as the second sprocket wheel 112. A second chain 120 extends between the third and fourth sprocket wheels 116 and 118. A first end of the second chain 120 is fixed to the third sprocket wheel 116 and a second end of the second chain is fixed to the fourth sprocket wheel 118.

An input wheel 122 is attached to the second end 108 of the drive shaft 106 outside of the third sprocket wheel 116 relative to the second leg 36. A first biasing element or spring (not shown) supports the upper portion 42 of the first leg 34 in an uppermost position within the lower portion 40 of the first leg. A second biasing element or spring (not shown) supports the upper portion 70 of the second leg 36 in an uppermost position within the lower portion 68 of the second leg.

To adjust the height of the crossbeam 38 of the support relative to the first and second leveling beams 62 and 94, the input wheel 122 is manually turned. When the crossbeam 38 is in an uppermost position, turning of the input wheel 122 rotates the first sprocket wheel 110 relative to the second sprocket wheel 112 and simultaneously rotates the third sprocket wheel 116 relative to the fourth sprocket wheel 118. As a result, a portion of the first chain 114 is engaged by the first sprocket wheel 110 and begins to wrap around the circumference of the first sprocket wheel and a portion of the second chain 120 is engaged by the third sprocket wheel 116 and begins to wrap around the circumference of the third sprocket wheel. This action reduced the length of the first chain 114 between the first and second sprocket wheels 110 and 112 and the length of the second chain 120 between the third and fourth sprocket wheels 116 and 118 and lowers the crossbeam 38 against the bias of the biasing elements. When a desired height is achieved, the thumbscrews (only thumbscrew 82 is shown) can be tightened to lock the crossbeam 38 of the support 32 at the desired height.

The device 30' further includes an upper rotary brush 210. The upper rotary brush 210 includes a core 212 that forms an axis of rotation for the upper rotary brush. A support shaft 214 projects axially through the core 212. A hub of the core 212 fixes the support shaft 214 relative to the core.

A plurality of bristles 216 projects radially outwardly from the core 212 of the upper rotary brush 210. The bristles 216 form a plurality of helically extending paths around the core 212. The bristles 216 may all have a common length or may be of differing lengths. Additionally, bristles 216 may all have a common thickness or may be of differing thickness.

The plurality of bristles 216 defines a working length WL of the upper rotary brush 210. The working length WL is measured in a direction parallel to the core 212 and is the portion of the upper rotary brush 210 that actually removes dust and debris from the upper surface 182 of the slip sheet 180. The working length WL of the upper rotary brush 210 is greater than the width WD of the upper surface 182 of the slip sheet 180. In one embodiment, the working length WL of the upper rotary brush 210 is sixty inches in length.

The upper brackets (only bracket 186 is shown) of the first and second legs 34 and 36 rotatably support the upper rotary brush 210. Opposite ends of the support shaft 214 of the upper rotary brush 210 extend through the rotary bearings in the support portions of the upper brackets 186. The rotary bearings enable rotation of the upper rotary brush 210 relative to the first and second legs 34 and 36.

An upper drive mechanism 218 is operatively connected to the upper rotary brush 210. The upper drive mechanism 218 includes an upper electric motor 220 and an upper drive device 222.

The upper electric motor 220 illustrated in FIG. 2 includes an output shaft (not shown) that extends perpendicular to the motor casing 224. The upper electric motor 220 includes a mounting flange (not shown) for mounting the upper electric motor 220 to the upper portion 70 of the second leg 36 so that the output shaft extends parallel to the support shaft 214 of the upper rotary brush 210. The present invention also contemplates alternative arrangements for extending an output shaft of an upper electric motor 220 parallel to the support shaft 214 of the upper rotary brush 210.

The upper drive device 222 includes first and second drive wheels (not shown) and a chain drive (not shown), all of which are enclosed by a first shroud 226. The first drive wheel is attached to the support shaft 214 of the upper rotary brush 210 on a side of the upper bracket opposite the bristles 216 of the upper rotary brush. The second drive wheel is supported on the output shaft of the upper electric motor 220. The first and second drive wheels are aligned with one anther and a drive chain extends around the first and second drive wheels. When the upper electric motor 220 is energized, the output shaft of the upper electric motor 220 rotates the second drive wheel. The drive chain transfers the drive force of the second drive wheel to the first drive wheel. Rotation of the first drive wheel rotates the upper rotary brush 210. The upper rotary brush 210 is rotated in a clockwise direction when viewed from the second leg 36 in FIG. 2.

The device 30' further includes a lower rotary brush 230. The lower rotary brush 230 includes a core 232 that forms an axis of rotation for the lower rotary brush. A support shaft 234 projects axially through the core 232. A hub of the core 232 fixes the support shaft 234 relative to the core.

A plurality of bristles 236 projects radially outwardly from the core 232 of the lower rotary brush 230. The bristles 236 form a plurality of helically extending paths around the core 232. The bristles 236 may all have a common length or may be of differing lengths. Additionally, bristles 236 may all have a common thickness or may be of differing thickness.

The plurality of bristles 236 defines a working length of the lower rotary brush 230. The working length is measured in a direction parallel to the core 232 and is the portion of the lower rotary brush 230 that actually removes dust and debris from the lower surface of the slip sheet 180. The lower rotary brush 230 has a working length that is equal to the working length WL of the upper rotary brush 210.

The lower brackets (only bracket 188 is shown) of the first and second legs 34 and 36 rotatably support the lower rotary brush 230. Opposite ends of the support shaft 234 of the lower rotary brush 230 extend through the rotary bearings in the support portions of the lower brackets 188. The rotary bearings enable rotation of the lower rotary brush 230 relative to the first and second legs 34 and 36.

A lower drive mechanism 238 is operatively connected to the lower rotary brush 230. The lower drive mechanism 238 includes a lower electric motor 240 and a lower drive device 242.

The lower electric motor 240 has an identical design as the upper electric motor 220. A mounting flange (not shown) of the lower electric motor 240 is attached to the upper portion 70 of the second leg 36 so that the output shaft extends parallel to the support shaft 234 of the lower rotary brush 230.

The lower drive device 242 also includes first and second drive wheels (not shown) and a chain drive (not shown), all of which are enclosed by a second shroud 246. The first drive wheel is attached to the support shaft 234 of the lower rotary brush 230 on a side of the lower bracket opposite the bristles 236 of the lower rotary brush. The second drive wheel is supported on the output shaft 234 of the lower electric motor 240. The first and second drive wheels are aligned with one anther and a drive chain extends around the first and second drive wheels. When the lower electric motor 240 is energized, the output shaft of the lower electric motor 240 rotates the second drive wheel. The drive chain transfers the drive force of the second drive wheel to the first drive wheel. Rotation of the first drive wheel rotates the lower rotary brush 230. The lower rotary brush 230 is rotated in a counter-clockwise direction when viewed from the second leg 36 in FIG. 2.

When the device 30' of FIG. 2 is used for cleaning slip sheets 180, the lower rotary brush 230 is spaced from the upper rotary brush 210 in a manner such that at least a portion of the bristles 236 of the lower rotary brush contact at least a portion of the bristles 216 of the upper rotary brush. The area in which the bristles 236 of the lower rotary brush 230 contact the bristles 216 of the upper rotary brush 210 forms a feed area of the device 30'. When the device 30' of FIG. 2 is used for cleaning wooden pallets 10, the lower rotary brush 230 is spaced further from the upper rotary brush 210. When the lower rotary brush 230 is spaced from the upper rotary brush 210, the feed area of the device 30' is a space defined between the bristles 216 of the upper rotary brush 210 and the bristles 236 of the lower rotary brush 230.

FIG. 2 illustrates a feed tray 250 for feeding the slip sheets 180 into the feed area of the device 30'. The feed tray 250 includes a planar surface 252. First and second flanges 254 and 256, respectively, extend upwardly from the surface 252. The first and second flanges 254 and 256 are both located with the working length WL of the upper and lower rotary brushes 210 and 230 to ensure that the entire width WD of the slip sheet 180 is cleaned when the slip sheet passes into the feed area of the device 30'. First and second rigid legs 260 and 262, respectively, extend downward from the feed tray 250 from supporting the feed tray. First and second rear brackets 264 and 266, respectively, connect the feed tray 250 to the upper portions 42 and 70 of the first and second legs 34 and 36, respectively, and align the feed tray 250 with the feed area of the device 30'.

When a slip sheet 180 is inserted into the feed area of the device 30', the upper rotary brush 210 contacts the upper surface 182 of the slip sheet 180 and the lower rotary brush 230 contacts the lower surface of the slip sheet. The rotation of the upper and lower rotary brushes 210 and 230 is such that any dust or debris on the slip sheet 180 is brushed toward the feed tray 250 and is removed from the slip sheet 180. Since the rotation of the upper and lower rotary brushes 210 and 230 tends to force the slip sheet 180 toward the feed tray 250, a force must be imparted upon to the slip sheet 180 to push or pull the slip sheet through the device 30'. This force may be applied manually or by any known device.

Since the working length WL of the upper and lower rotary brushes 210 and 230 is greater than a width WD of the slip sheet 180, the device 30' simultaneously remove sawdust and other debris across the width to the upper and lower surfaces (only surface 182 is shown) of the slip sheet 180.

The device 30' of FIG. 2 works in a similar manner when used to remove dust and other debris from the upper and lower deck surfaces 24 and 20 of a wooden pallet 10. During movement of the wooden pallet 10 relative to the device 30', the upper and lower rotary brushes 210 and 230 remove dust and debris from the upper and lower deck surfaces 24 and 20, respectively.

From the above description of the invention, those skilled in the art will perceive improvements, changes and modifications. Such improvements, changes and modifications within the skill of the art are intended to be covered by the appended claims.

Having described the invention, I claim the following:

1. A device for removing sawdust and other debris from a deck surface of a wooden pallet, the device comprising:

a rotary brush having a working length defined by a plurality of bristles, the working length being greater than a width of the deck surface of the wooden pallet;

a mechanism being connected with the rotary brush, the mechanism being actuatable for rotating the rotary brush; and a support for rotatably supporting the rotary brush, the mechanism being fixed relative to the support, rotation of the rotary brush when the bristles are in contact with the deck surface of the wooden pallet simultaneously removing sawdust and debris across the width of the deck surface, the support including first and second legs between which the rotary brush is located, the first and second legs having adjustable lengths, adjustment of the lengths of the first and second legs moving the rotary brush into a position for contacting the wooden pallet; and the first and second legs including telescoping portions that enable adjustment of the lengths of the first and second legs, sprocket wheels and chains are associated with the telescoping portions of the first and second legs for adjusting the lengths of the first and second legs and the position of the rotary brush.

2. The device as defined in claim 1 wherein the support includes locks for locking the rotary brush at a desired position.

3. The device as defined in claim 2 wherein the locks includes apertures in the telescoping portions of the first and second legs and thumbscrews for projecting through the apertures.

4. The device as defined in claim 1 further includes an input wheel and a drive shaft for rotating the sprocket wheels and adjusting the position of the rotary brush by simultaneously telescoping the first and second legs of the support.

5. The device as defined in claim 1 wherein the mechanism includes an electric motor that is connected with the rotary brush.

6. The device as defined in claim 5 wherein the mechanism further includes first and second pulleys and a drive belt, a first pulley being fixed relative to the rotary brush and a second pulley being fixed to an output shaft of the electric motor, rotation of the second pulley being transferred to the first pulley by the drive belt.

7. The device as defined in claim 1 further including a vacuum system for suctioning dust and debris removed by the rotary brush.

8. The device as defined in claim 7 wherein the vacuum system extends across the working length of the rotary brush.

9. The device as defined in claim 8 wherein the vacuum system is actuated by an electronic eye.

10. The device as defined in claim 7 wherein the vacuum system further includes first and second hoods for receiving dust sawdust and other debris.

11. The device of claim 1 further including an air flow system for directing air at the wooden pallet.

12. The device as defined in claim 11 wherein the air flow system includes a plenum that is attached to the support and a plurality of nozzles for directing air toward the wooden pallet.

13. The device as defined in claim 12 wherein the air flow system is actuated by the electronic eye.

14. The device as defined in claim 1 wherein the mechanism is actuated by the electronic eye.

15. A method of removing sawdust and other debris from a deck surface of a wooden pallet, the method comprising the steps of:

providing a rotary brush having a working length defined by a plurality of bristles, the working length being greater than a width of the deck surface of the wooden pallet;

providing a mechanism for rotating the rotary brush;

rotatably supporting the rotary brush; and actuating the mechanism to rotate the rotary brush so that when bristles of the rotary brush contact the deck surface of the wooden pallet sawdust and debris is simultaneously removed across the width of the deck surface.

16. The method as defined in claim 15 further including the step of:

adjusting a position of the rotary brush so that the bristles of the rotary brush will contact the deck surface of the wooden pallet.

17. The method as defined in claim 15 further including the step of providing a vacuum system to collect sawdust or debris removed from the wooden pallet.

18. The method as defined in claim 17 further including the step of actuating the vacuum system as the wooden pallet approaches the rotary brush.

19. The method as defined in claim 18 wherein the step of actuating the vacuum system includes sensing the presence of the wooden pallet with an electronic eye.

20. The method as defined in claim 15 further including the step of directing air flow at the wooden pallet to removed sawdust and debris from the wooden pallet.

21. The method as defined in claim 20 further including the step of actuating the air flow as the wooden pallet approaches the rotary brush.

22. The method as defined in claim 21 wherein the step of actuating the air flow includes sensing the presence of the wooden pallet with an electronic eye.

23. The method as defined in claim 15 wherein the step of actuating the mechanism further includes the steps of sensing the presence of the wooden pallet with an electronic eye and actuating the mechanism when the presence of the wooden pallet is sensed.

24. The method as defined in claim 15 further including the step of adjusting a position of the rotary brush so that the bristles of the rotary brush contact the deck surface of the wooden pallet.

25. A device for removing dust and other debris from a member upon which goods are stored and transported, the device comprising:

a first rotary brush having a working length defined by a plurality of bristles, the working length of the first rotary brush being greater than a width of an upper stacking surface of the member;

a support for rotatably supporting the first rotary brush and locking the first rotary brush in a position for enabling the working length of the first rotary brush to overlie and contact the width of the upper stacking surface of the member, the support including first and second legs between which the first rotary brush is located, the first and second legs having adjustable lengths, adjustment of the lengths of the first and second legs moving the first rotary brush into the position in which the first rotary brush overlies and contacts the upper stacking surface of the member; and a first drive mechanism being connected with the first rotary brush and being energizable for rotating the first rotary brush to remove dust and debris across the width of the upper stacking surface during movement of the member relative to the device; and the first and second legs including telescoping portions for enabling a length of each of the first and second legs to be adjusted for adjusting a position of the first rotary brush.

26. The device as defined in claim 25 further including a mechanism for simultaneously adjusting the length of the first and second legs by causing the telescoping portions of the first and second legs to move together in response to actuation of a height adjustment input.

27. The device as defined in claim 25 wherein the support includes apertures in the telescoping portions of the first and second legs and thumbscrews for projecting through the apertures for locking the telescoping portions of the first and second legs and thereby, locking the position of the first rotary brush.

28. The device as defined in claim 25 wherein the drive mechanism includes an electric motor that is connected with the rotary brush.

29. The device as defined in claim 25 further including a second rotary brush having a plurality of bristles for contacting a lower support surface of the member;

the support rotatably supporting the second rotary brush in a position for enabling the second rotary brush to contact the lower support surface of the member; and a second drive mechanism being connected with the second rotary brush and being energizable for rotating the second rotary brush to remove dust and debris from the lower support surface during movement of the member relative to the device.

30. The device as defined in claim 29 wherein the second rotary brush has a working length that is greater than a width of the lower support surface of the member, the working length of the second rotary brush contacting the width of the lower support surface of the member and removing dust and debris across the width of the lower support surface during rotation of the second rotary brush as the member moves relative to the device.

31. A method of removing dust and other debris from a member upon which goods are stored and transported during movement of the member relative to the device, the method comprising the steps of:

providing a first rotary brush having a working length defined by a plurality of bristles, the working length being greater than a width of the an upper stacking surface of the member;

rotatably supporting the first rotary brush;

locking the first rotary brush in a position for enabling the working length of the first rotary brush to overlie and contact the width of the upper stacking surface of the member; and energizing a first drive mechanism, that is connected with the first rotary brush, for rotating the first rotary brush to remove dust and debris across the width of the upper stacking surface during movement of the member relative to the device;

providing a second rotary brush having a working length defined by a plurality of bristles, the working length being greater than a width of the a lower support surface of the member;

rotatably supporting the second rotary brush;

locking the second rotary brush in a position for enabling the working length of the second rotary brush to contact the width of the lower support surface of the member; and energizing a second drive mechanism, that is connected with the second rotary brush, for rotating the second rotary brush to remove dust and debris across the width of the lower support surface during movement of the member relative to the device.

32. The method as defined in claim 31 further including the step of:

adjusting a position of the first rotary brush so that the bristles of the first rotary brush contact the upper stacking surface of the member.

* * * * *